US008525858B2

(12) United States Patent
Herring et al.

(10) Patent No.: US 8,525,858 B2
(45) Date of Patent: Sep. 3, 2013

(54) DETECTING PRINT LINE LOSS

(75) Inventors: Dean F. Herring, Youngsville, NC (US); Kevin H. Vorhees, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 336 days.

(21) Appl. No.: 12/967,998

(22) Filed: Dec. 14, 2010

(65) Prior Publication Data

US 2012/0147117 A1 Jun. 14, 2012

(51) Int. Cl.
*B41J 2/32* (2006.01)

(52) U.S. Cl.
USPC ..... 347/171; 347/179; 347/222

(58) Field of Classification Search
USPC ..... 347/171, 197, 222
See application file for complete search history.

(56) References Cited

U.S. PATENT DOCUMENTS

| | | | | |
|---|---|---|---|---|
| 7,033,097 | B2 * | 4/2006 | Petteruti et al. | 400/693 |
| 7,038,703 | B2 * | 5/2006 | Ehrhardt | 347/171 |
| 2005/0024409 | A1 * | 2/2005 | Ehrhardt | 347/16 |

FOREIGN PATENT DOCUMENTS

WO WO 2004/056577 7/2004

* cited by examiner

*Primary Examiner* — Huan Tran
(74) *Attorney, Agent, or Firm* — H. Barrett Spraggins; Thomas E. Tyson; Biggers & Ohanian, LLP

(57) ABSTRACT

Printers and methods of printer operation are disclosed for detecting print line loss. Embodiments include at least one stable frame element and a print head that is moveable with respect to the stable frame element; and at least two optical elements mounted on one or more of the stable frame element and the print head, the optical elements oriented with respect to one another so as to detect motion of the print head.

15 Claims, 9 Drawing Sheets

DETECTING PRINT LINE LOSS

BACKGROUND OF THE INVENTION

1. Field of the Invention

The field of the invention is data processing, or, more specifically, methods and printers for detecting print line loss.

2. Description of Related Art

To properly perform a printing operation, components of a printer may need to be in a particular position. Opening or closing the lid of the printer may change the position of the components such that the printing operation is disrupted.

SUMMARY OF THE INVENTION

Printers and methods of printer operation are disclosed for detecting print line loss. Embodiments include at least one stable frame element and a print head that is moveable with respect to the stable frame element; and at least two optical elements mounted on one or more of the stable frame element and the print head, the optical elements oriented with respect to one another so as to detect motion of the print head.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION OF EXEMPLARY EMBODIMENTS

Figure 1:
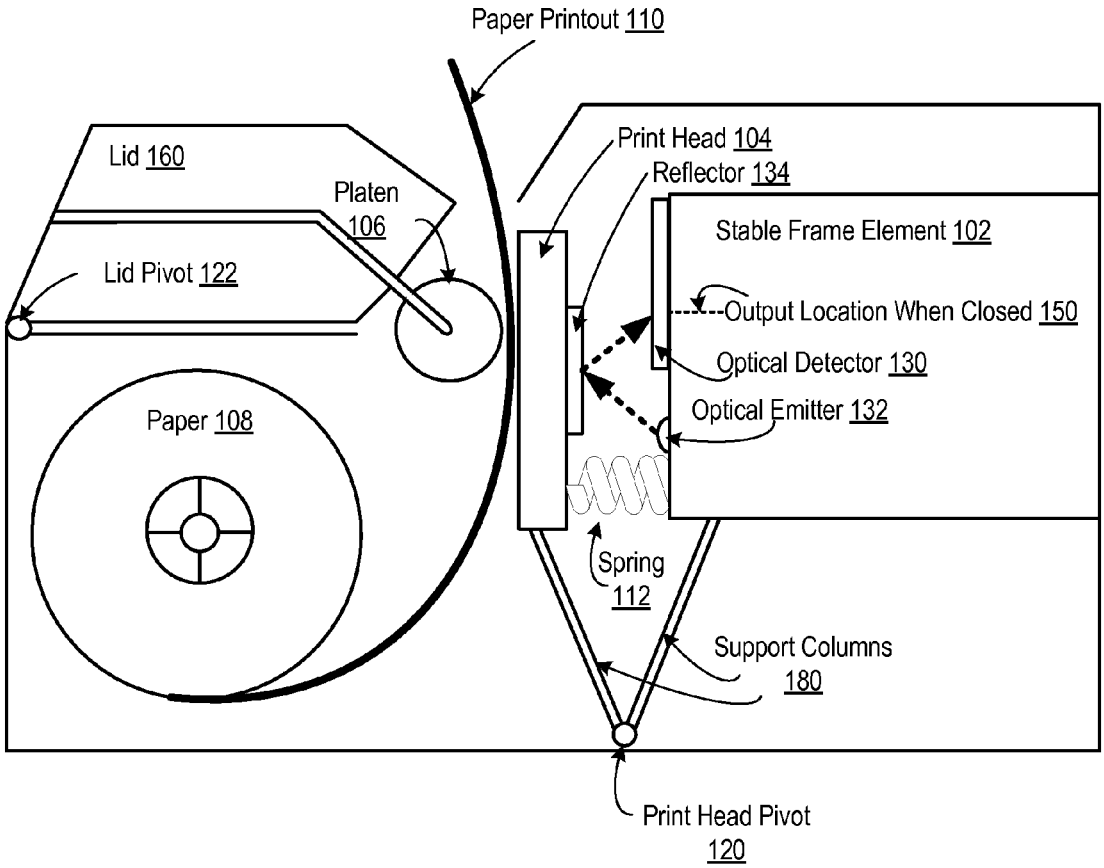
FIG. 1 sets forth a line drawing of an example of a printer that detects print line loss according to embodiments of the present invention.

Examples of printers and methods of printer operation for detecting print line loss in accordance with the present invention are described with reference to the accompanying drawings, beginning with FIG. 1. FIG. 1 sets forth a line drawing of an example of a printer that detects print line loss according to embodiments of the present invention. The printer of FIG. 1 may be a thermal printer. A thermal printer produces a printed image by selectively heating coated thermochromic paper, or thermal paper, when the paper passes over a thermal print head. The coating turns black in the areas where it is heated, producing an image.

The printer of FIG. 1 includes a print head (104). A print head is the component of a printer that applies the mark or image to paper. In a thermal printer, an image or mark is created by a print head heating portions of the print head and pressing the paper onto the print head, turning the paper black in the heated areas of the print head.

The printer of FIG. 1 includes a platen (106). A platen is a roller against which the print head (104) presses paper. The platen (106) of FIG. 1 is part of a lid (160) of the printer. The lid (160) of the printer is capable of moving between an open position and a closed position by rotating on a lid pivot (122). During operation of the printer, a paper printout (110) is printed by unrolling the paper printout (110) from a paper roll (108) and passing the paper printout (110) between the print head (104) and the platen (106). When the lid (160) of the printer is in the closed position, as illustrated in FIG. 1, the platen (106) presses against the print head (104) such that the print head (104) prints an image or mark on the paper printout (110).

The print head (104) of FIG. 1 is connected to a stable frame element (102) of the printer by a spring (112) and support columns (180). The spring (112) provides a force that pushes the print head (104) away from the stable frame element (102) and into the platen (106). One of the support columns (180) is coupled to the print head (104) and a print head pivot (120) and the other support column (180) is coupled to the stable frame element (102) and the print head pivot (120) such that the print head pivot (120) enables the print head (104) to rotate away from the stable frame element (102).

The printer of FIG. 1 includes optical elements for detecting the motion of the print head (104) relative to the stable frame element (102). In FIG. 1, the optical elements include an optical emitter (132), an optical detector (130), and a reflector (134). An optical emitter is a device that emits light, such as a light emitting diode (LED). A reflector is a piece of material, such as glass, possessing properties that enable the light emitting from an optical emitter to be reflected to an optical detector. An optical detector is a device that converts light to voltage levels, such as a charge coupled device (CCD).

During operation, the optical emitter (132) generates an optical output that is reflected off the reflector (134) onto the optical detector (130) at an output location (150) that corresponds with the lid (160) in the closed state. Moving the lid (160) moves the platen (106) and the print head (104). The optical detector (130) may be used to detect the movement of the print head (104) during printing and subsequently enable the printer to instruct the user to close the lid to ensure that the platen (106) connects with the print head (104). One of skill in the art will recognize that the spring (112), the support columns (180), the print head pivot (120), the optical emitter (132), the optical detector (130), and the reflector (134) may be positioned in different configurations on the print head (104) and the stable frame element (102).

Figure 2:
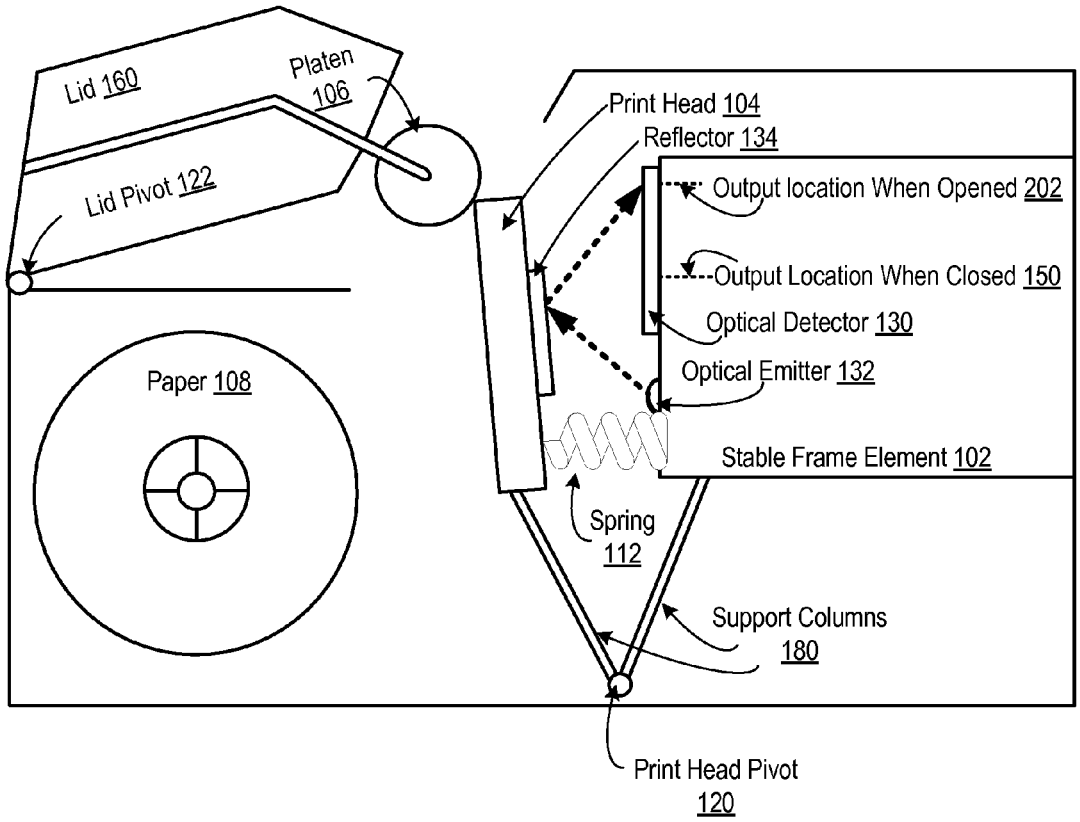
FIG. 2 sets forth a line drawing of a further example of a printer that detects print line loss according to embodiments of the present invention.

FIG. 2 sets forth a line drawing of a further example of a printer that detects print line loss according to embodiments of the present invention. The printer components in the example of FIG. 2 are similar to the components of the printer of FIG. 1 in that the printer of FIG. 2 includes the lid (160), the lid pivot (122), the platen (106), the paper (108), the print head (104), the reflector (134), the spring (112), the print head pivot (120), the optical detector (130), the optical emitter (132), the support columns (180), and the stable frame element (102) of the printer of FIG. 1.

In the example of FIG. 2, however, the lid (160) of the printer is in an opened position. As the lid (160) is opened, the platen (106) is rotated in a direction away from the print head (104). In response to the platen (106) rotating away from the print head (104), the spring (112) applies a force that rotates the print head (104) away from the stable frame element (102) and toward the platen (106). Moving the print head (104) away from the stable frame element (102) increases the distance between the optical output of the optical emitter (132) and the reflector (134), and therefore changes the position that the optical output is reflected onto the optical detector (130).

The optical detector (130) of FIG. 2 is configured to detect the different locations of the optical output of the optical emitter (132). The output location (150) of the optical output when the lid (160) is closed is a different position that the output location (202) of the optical output when the lid (160) is opened. The output of the optical detector (130) may indicate which location the optical output of the emitter (132) is hitting and may be used to determine whether the platen (106) is in a correct position with the print head (104) to enable proper printing by the printer. When the lid (160) is in the opened position, the platen (106) of FIG. 2 does not make correct contact with the print head (104). If the print head (104) does not have the correct contact with the platen (106), the printer may print with line loss. Print line loss is the non-transference by a print head of a portion of an image or mark to paper. The optical elements of the printer are used to detect conditions in which print line loss would occur so that the user of the printer may be alerted.

Figure 3:
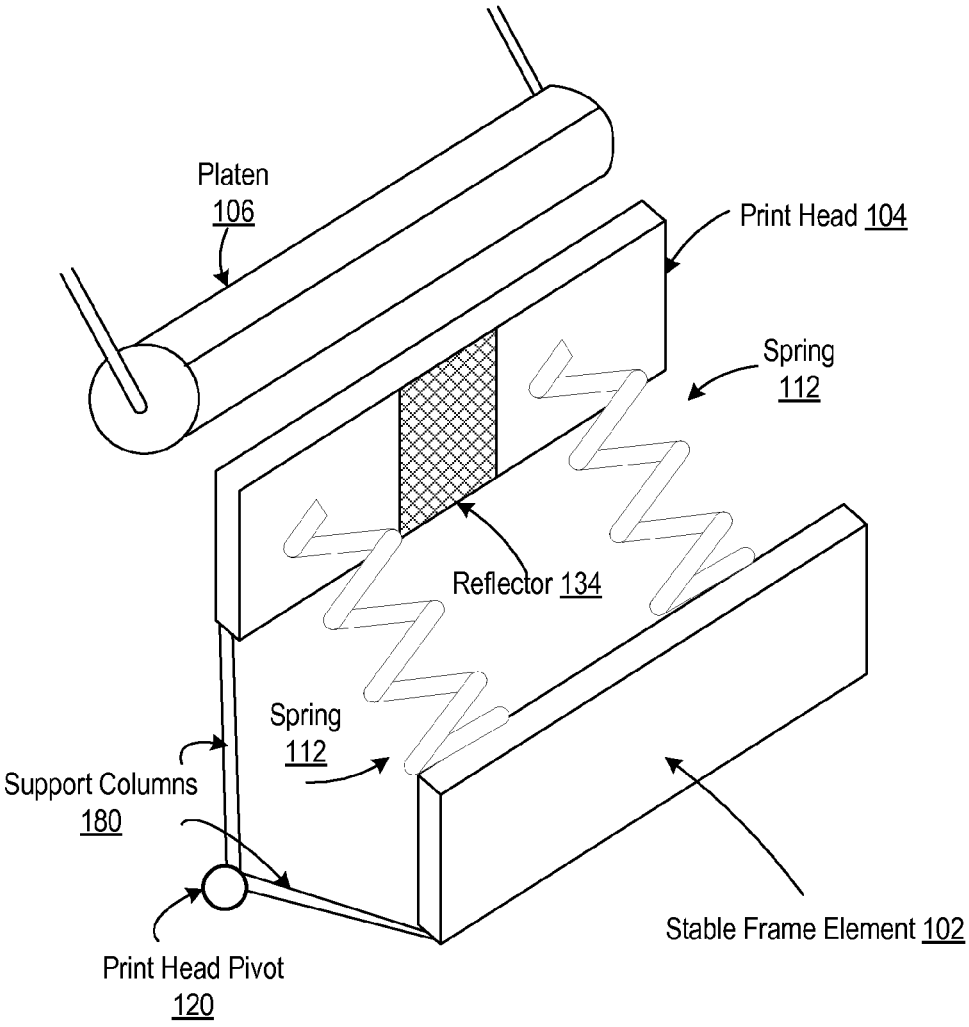
FIG. 3 sets forth a line drawing of components of a further example of a printer that detects print line loss according to embodiments of the present invention.

FIG. 3 sets forth a line drawing of components of a further example of a printer that detects print line loss according to embodiments of the present invention. The printer components in the example of FIG. 3 are similar to the components of the printer of FIG. 1 in that the printer of FIG. 3 includes the platen (106), the print head (104), the reflector (134), the spring (112), the print head pivot (120), the support columns (180), and the stable frame element (102) of the printer of FIG. 1. In the example of FIG. 3, however, multiple springs (112) are illustrated as coupling the print head (104) to the stable frame element (102). The platen (106) is illustrated in FIG. 3 as separated from the print head (104), such as when the lid (160) is in the opened position.

Figure 4:
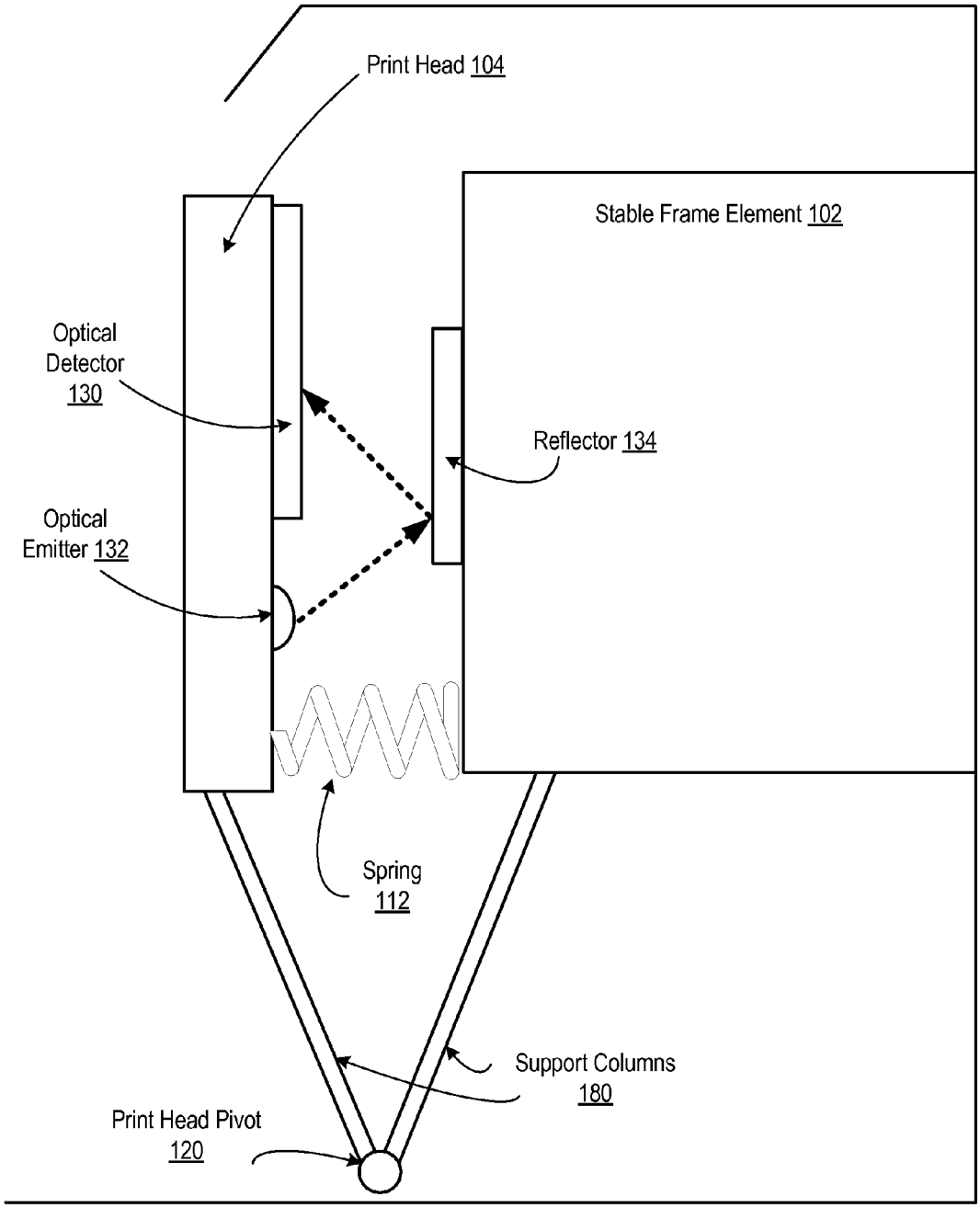
FIG. 4 sets forth a line drawing of components of a further example printer that detects print line loss according to embodiments of the present invention.

FIG. 4 sets forth a line drawing of components of a further example of a printer that detects print line loss according to embodiments of the present invention. The printer components in the example of FIG. 4 are similar to the components of the printer of FIG. 1 in that the printer of FIG. 4 includes the print head (104), the stable frame element (102), the reflector (134), the spring (112), the print head pivot (120), the support columns (180), and the stable frame element (102) of the printer of FIG. 1. In the example of FIG. 4, however, both the optical emitter (132) and the optical detector (130) are located on the print head (104) and the reflector (134) is located on the stable frame element (102).

Figure 5:
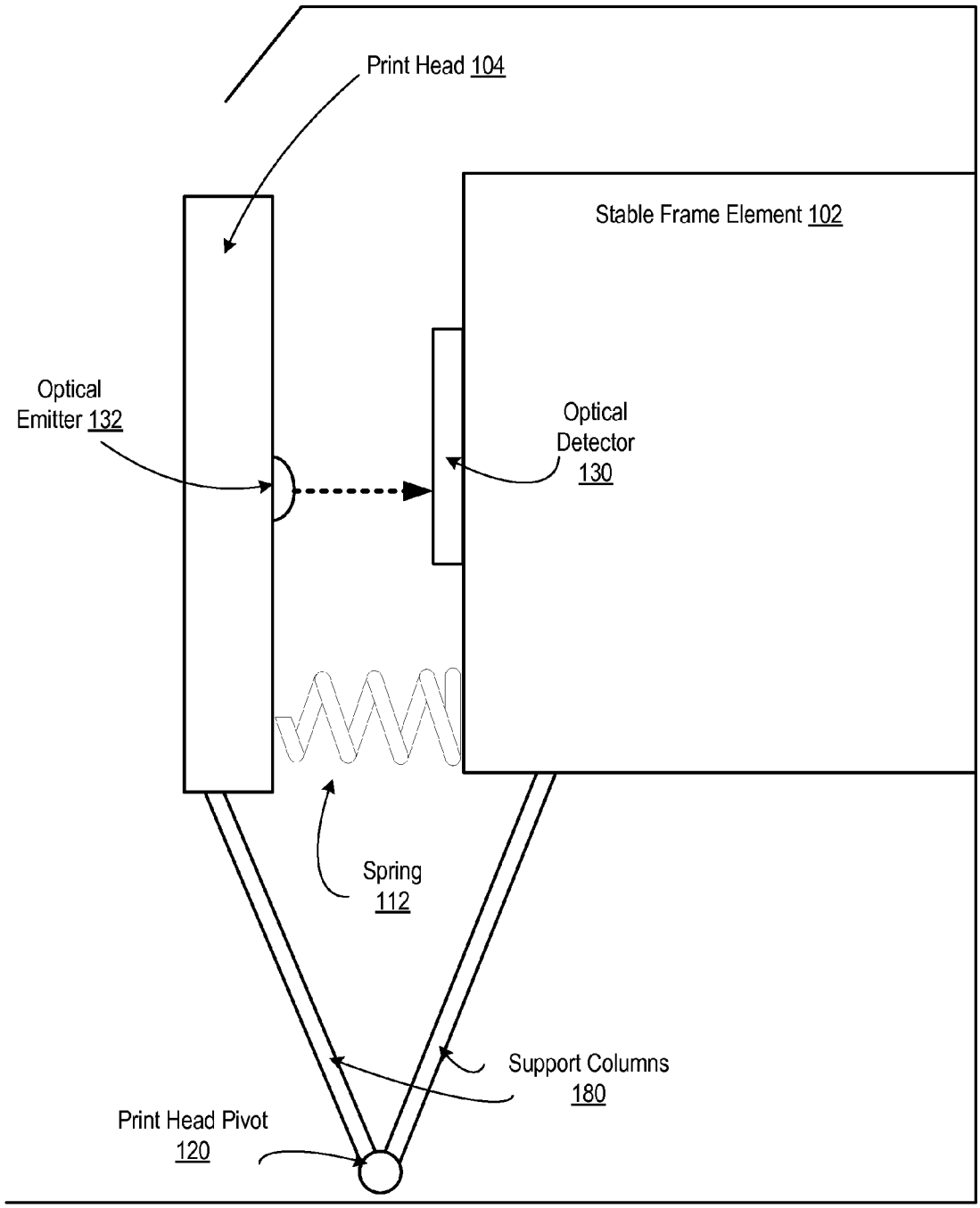
FIG. 5 sets forth a line drawing of components of a further example of a printer that detects print line loss according to embodiments of the present invention.

FIG. 5 sets forth a line drawing of components of a further example of a printer that detects print line loss according to embodiments of the present invention. The printer components in the example of FIG. 5 are similar to the components of the printer of FIG. 1 in that the printer of FIG. 5 includes the print head (104), the stable frame element (102), the reflector (134), the spring (112), the print head pivot (120), the support columns (180), and the stable frame element (102) of the printer of FIG. 1. In the example of FIG. 5, however, the optical emitter (132) is located on the print head (104) and the optical detector (130) is located on the stable frame element (102), such that the optical output of the optical emitter (132) directly hits the optical detector (130) without use of the reflector (134) of FIG. 1.

Figure 6:
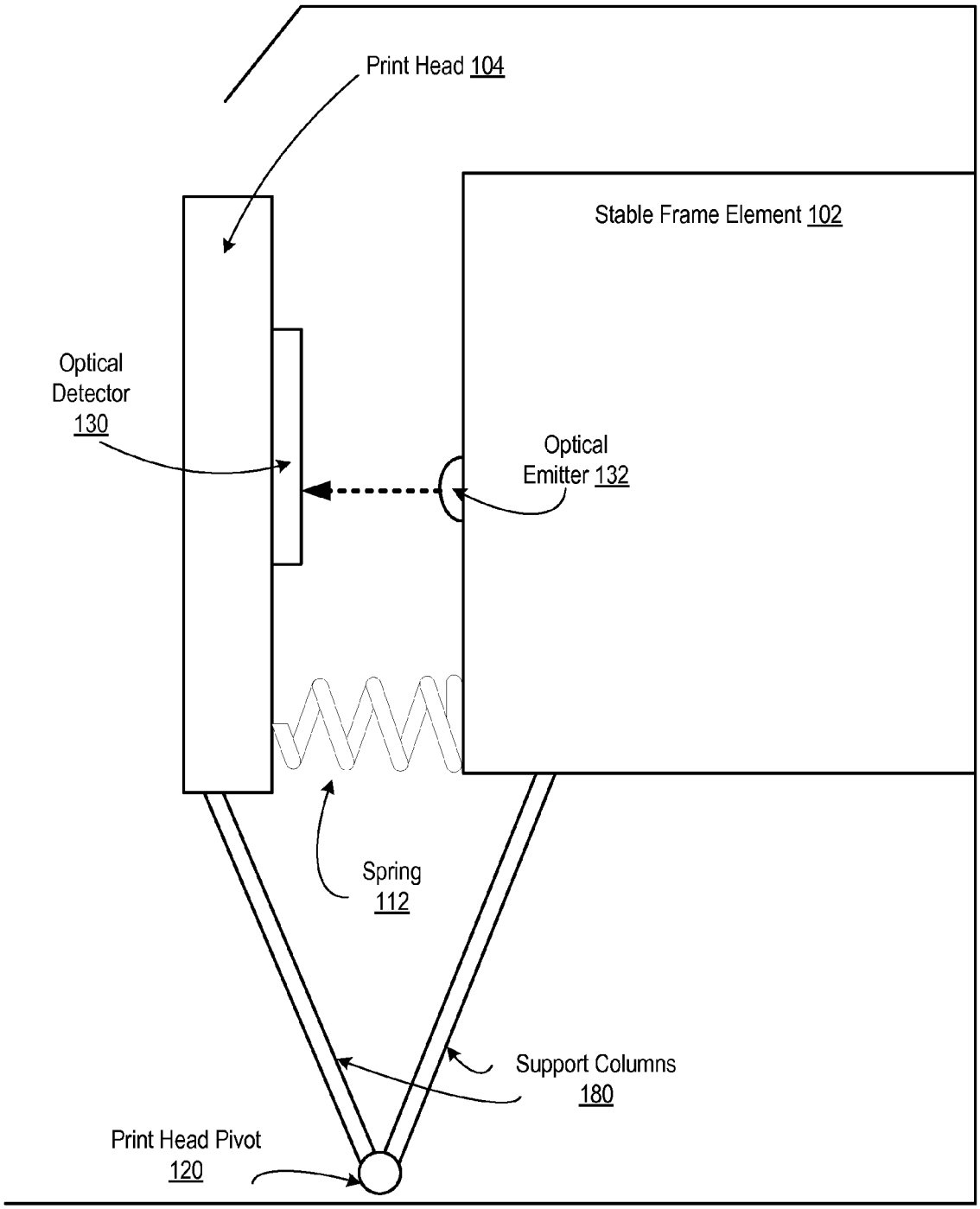
FIG. 6 sets forth a line drawing of components of a further example of a printer that detects print line loss according to embodiments of the present invention.

FIG. 6 sets forth a line drawing of components of a further example of a printer that detects print line loss according to embodiments of the present invention. The printer components in the example of FIG. 6 are similar to the components of the printer of FIG. 1 in that the printer of FIG. 6 includes the print head (104), the stable frame element (102), the reflector (134), the spring (112), the print head pivot (120), the support columns (180), and the stable frame element (102) of the printer of FIG. 1. In the example of FIG. 6, however, the optical emitter (132) is located on the stable frame element (102) and the optical detector (130) is located on the print head (104), such that the optical output of the optical emitter (132) directly hits the optical detector (130) without use of the reflector (134) of FIG. 1.

Figure 7:
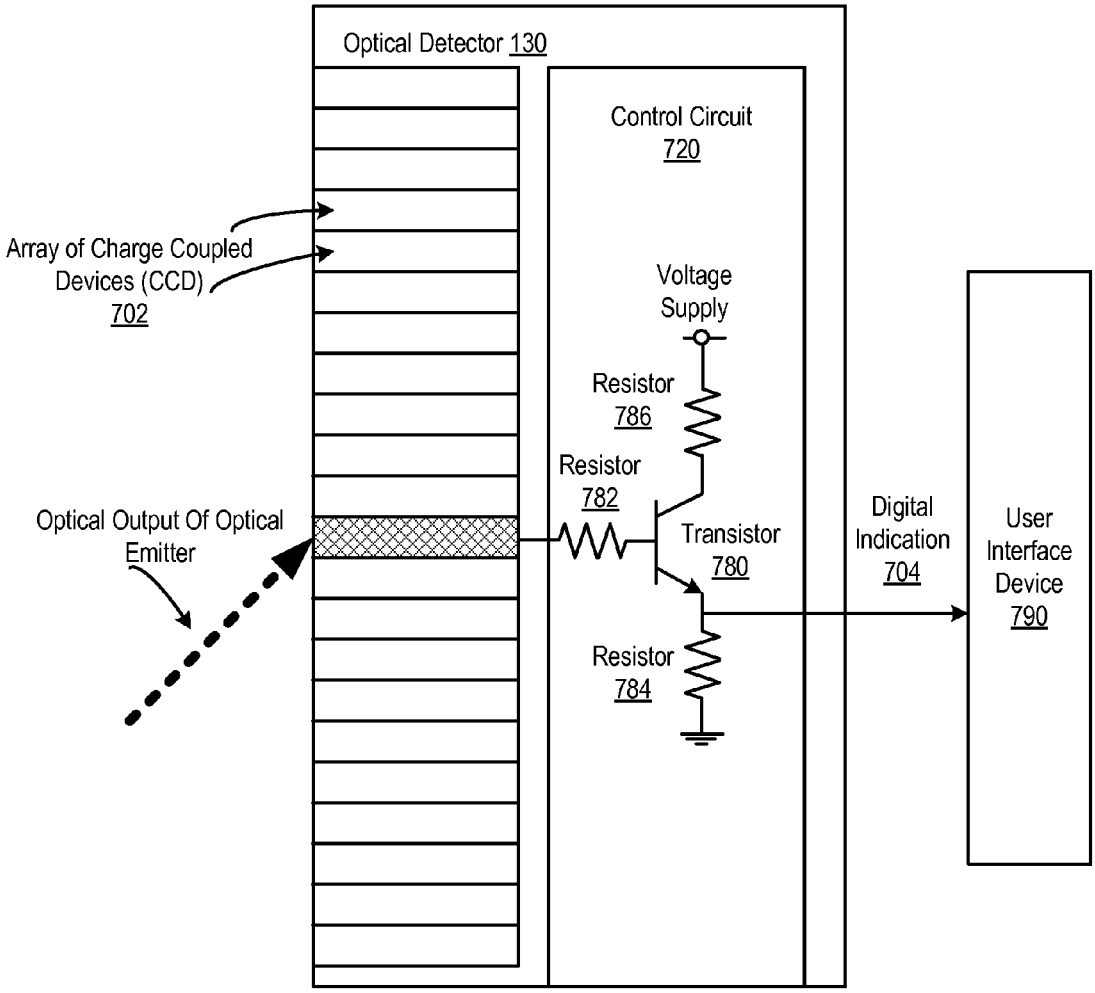
FIG. 7 sets forth a line drawing of components of a further example of a printer that detects print line loss according to embodiments of the present invention.

FIG. 7 sets forth a line drawing of components of a further example of a printer that detects print line loss according to embodiments of the present invention. The printer components in the example of FIG. 7 are similar to the components of the printer of FIG. 1 in that the printer of FIG. 7 includes the optical detector (130) of the printer of FIG. 1.

In the example of FIG. 7, however, the optical detector (130) includes an array (702) of charge coupled devices (CCDs). A CCD is device for the movement of electrical charge, usually from within the CCD to an area where the charge can be manipulated, for example conversion into a digital value. This is achieved by "shifting" the signals between stages within the CCD one at a time. A CCD moves charge between capacitive bins in the CCD, with the shift allowing for the transfer of charge between bins. The array (702) of CCDs of FIG. 7 is a one-dimensional array. Once the array (702) has been exposed to the optical output of the emitter (132), a control circuit (720) causes each capacitor bin to transfer its contents to its neighbor (operating as a shift register). The last capacitor in the array (702) transmits a CCD output (715) to a control circuit (720) that includes resistors (782, 784, and 786) and a transistor (780). To sample the CCD output (715), the control circuit (720) periodically applies a voltage supply to the transistor (780) such that the transistor (780) reads the CCD output (715) and outputs a digital indication (704). The control circuit (720) may include any number of components to generate a digital indication of the charge of the array (702) of CCDs.

In the example of FIG. 7, a user interface device (790) receives the digital indication (704) of the optical detector (130). The user interface device (790) may be configured to determine, based on the digital indication (704), whether the platen (106) is in the correct position. The user interface device (790) may be use the digital indication (704) to determine a location of the optical output of the optical emitter. For example, a digital indication (704) represented as "00000000000010000000000" may indicate that the optical output of the optical emitter is striking the array (702) of CCDs in a central location. As another example, a digital indication (704) represented as "00000000000000000010" may indicate that the optical output of the optical emitter is striking the array (702) of CCDs in an off-center location. A central location may indicate that the platen (106) is in the correct position with the print head (104), whereas an off-center location may be used to indicate that the optical output of the optical emitter is striking the array (702) of CCDs in an off-center location. When the user interface device (790) determines that the platen (106) is not in the correct position, the user interface device (790) may display a message to a user of the printer. Messages displayed by the user interface device (790) may include warnings such as instructions to close the lid or that print line loss is detected.

Figure 8:
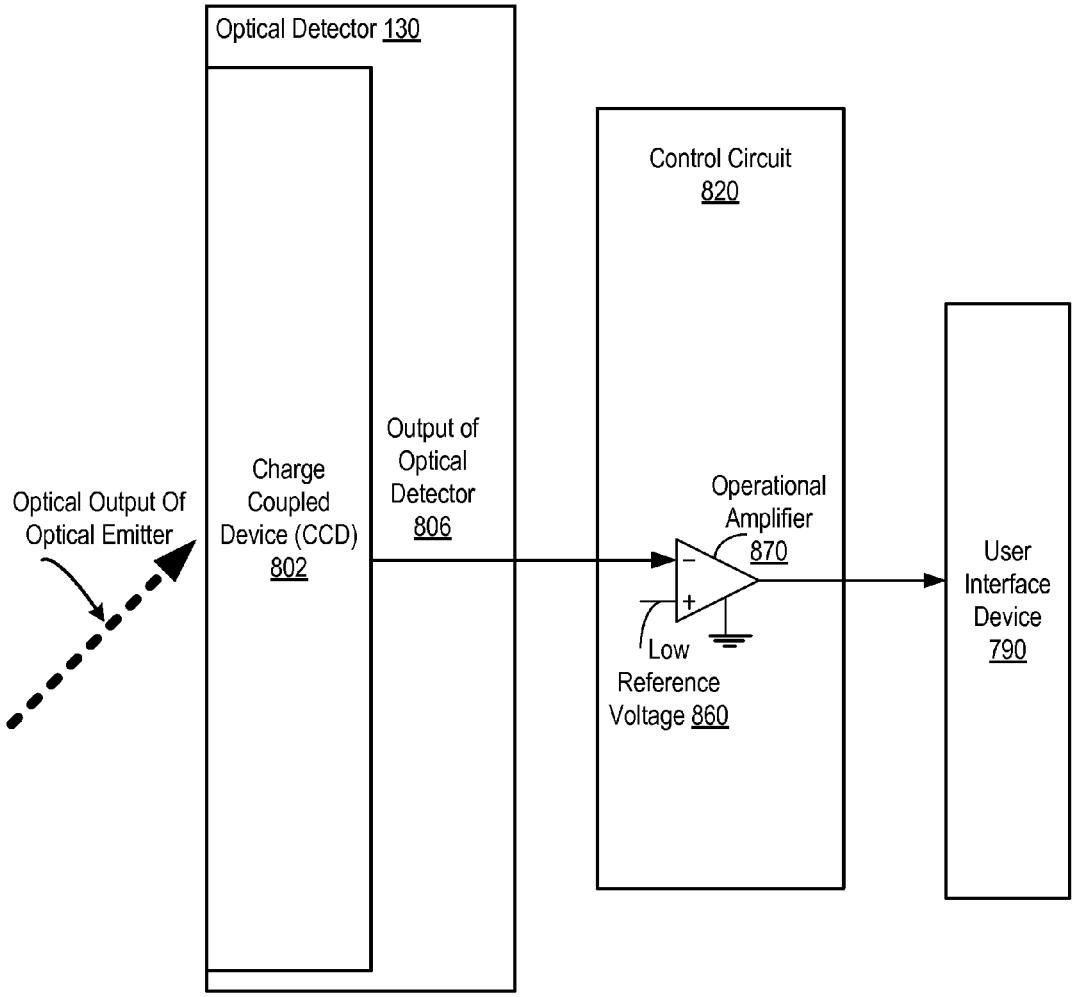
FIG. 8 sets forth a line drawing of components of a further example of a printer that detects print line loss according to embodiments of the present invention.

FIG. 8 sets forth a line drawing of components of a further example of a printer that detects print line loss according to embodiments of the present invention. The printer components in the example of FIG. 8 are similar to the components of the printer of FIG. 1 in that the printer of FIG. 8 includes the optical detector (130) of the printer of FIG. 1.

In the example of FIG. 8, however, the optical detector (130) includes a single charge coupled device (CCD) (802). Once the CCD (802) is exposed to the optical output of the emitter (132), the CCD (802) generates an output (806). The output (806) may correspond with the location on the CCD (802) that the optical emitter output is striking For example, a low voltage level for the output (806) may correspond with the optical emitter output striking an off-center location on the CCD (802) and a high voltage level may correspond with the optical emitter output striking a center location on the CCD (802).

In the example of FIG. 8, a control circuit (820) samples the output (806) of the optical detector (806). The control circuit (820) includes an operational amplifier (870) for comparing the output (806) of the optical detector (130) to a low reference voltage (860). The low reference voltage (860) may correspond with a voltage level that the CCD (802) generates when the optical emitter output strikes an off-center location or another location corresponding with the platen (106) not being in position with the print head (104). If the low reference voltage (860) corresponds with whether the output of the optical emitter is striking the CCD (802) such that the platen (106) is in the correct position, the output of the operational amplifier (870) indicates whether the platen (106) is in the correct position. The output of the operational amplifier (870) is transmitted to the user interface device (790). Based on the output of the operational amplifier (870), the user interface device (790) determines whether the platen (106) is in position with the print head (104). The output of the operational amplifier (870) may be considered a linear output as a high voltage level may correspond with an out of position platen and a low voltage level may correspond with a platen that is in position.

Figure 9:
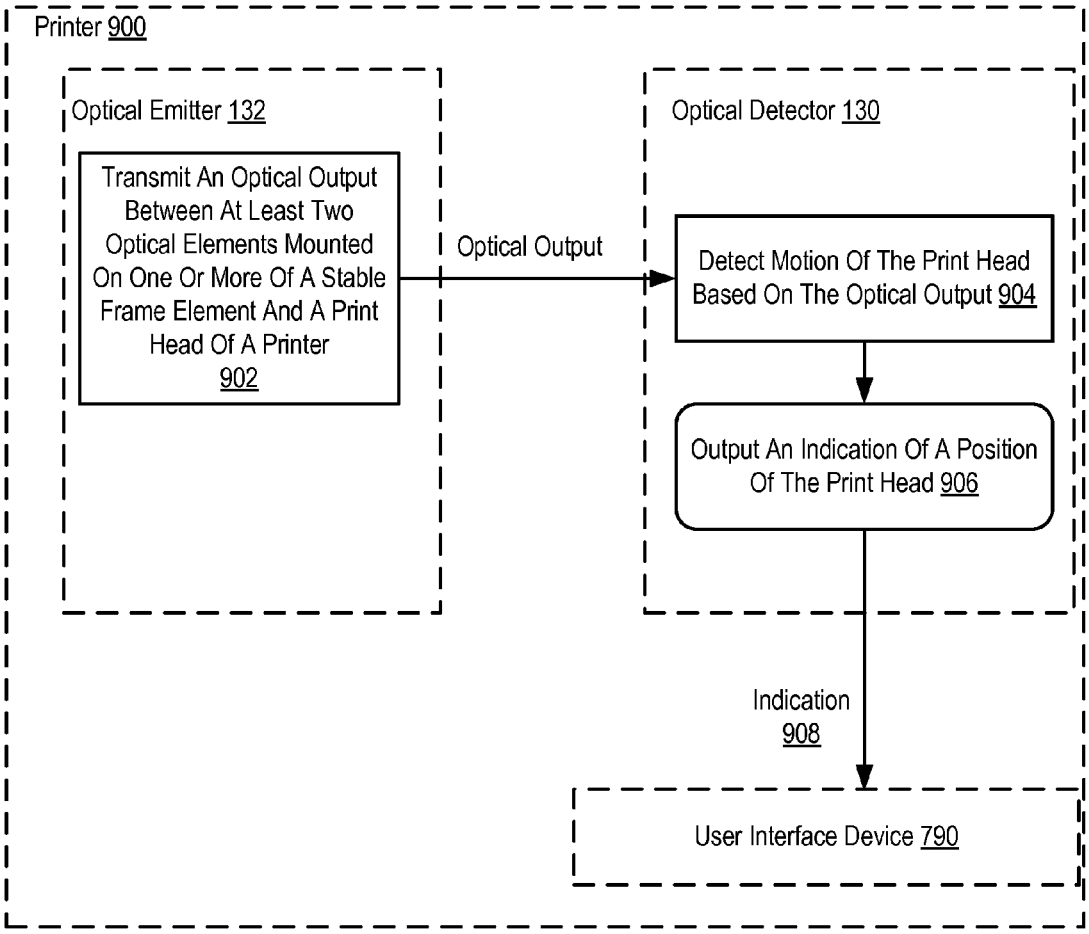
FIG. 9 sets forth a flow chart illustrating an example of a method of printer operation for detecting print line loss according to embodiments of the present invention.

For further explanation, FIG. 9 sets forth a flow chart illustrating an example of a method of printer operation for detecting print line loss according to embodiments of the present invention. The method of FIG. 9 includes transmitting (902) an optical output between at least two optical elements (132, 130) mounted on one or more of a stable frame element (102) and a print head (104) of a printer. Transmitting the optical output may be carried out by emitting the optical output from the optical emitter (132) and receiving the optical output at the optical detector (130).

The method of FIG. 9 also includes detecting (904), by one of the two optical elements, motion of the print head based on the optical output. Detecting (904) motion of the print head based on the optical output may be carried out by generating a charge at a section of the optical detector (130) in response to that section receiving the optical output from the optical emitter (132) and correlating the charge to motion of the print head.

The method of FIG. 9 may optically include outputting (906), by the optical detector (130), an indication (908) of a position of the print head. Outputting (906) the indication (908) of a position of the print head may be carried out by generating a voltage that represents the position of the print head and outputting the voltage and transmitting the voltage to the user interface device (790). The user interface device (790) may include a display for displaying to a user of the printer a message that line loss is detected.

It will be understood from the foregoing description that modifications and changes may be made in various embodiments of the present invention without departing from its true spirit. The descriptions in this specification are for purposes of illustration only and are not to be construed in a limiting sense. The scope of the present invention is limited only by the language of the following claims.

What is claimed is:

1. A printer that detects print line loss, the printer comprising:

at least one stable frame element and a print head that is moveable with respect to the stable frame element; and at least two optical elements comprising an optical emitter and an optical detector, at least one of the two optical elements mounted on the print head, the optical elements oriented with respect to one another so as to detect motion of the print head.

2. The printer of claim 1, wherein the printer is a fiscal printer.

3. The printer of claim 1, wherein the optical emitter is mounted on the stable frame element; and the optical detector is mounted on the print head, the optical detector oriented so that it receives an optical output from the optical emitter, the optical detector having an output indicative of a position of the print head.

4. The printer of claim 1, wherein the optical emitter is mounted on the print head; and the optical detector is mounted on the stable frame element, the optical detector oriented so that it receives an optical output from the optical emitter, the optical detector having an output indicative of a position of the print head.

5. The printer of claim 1 further comprising a reflector mounted on the stable frame element;

wherein the optical emitter is mounted on the print head;

wherein the optical detector is mounted on the print head;

wherein the reflector is oriented so that it receives an optical output from the optical emitter and the optical detector is oriented so that it receives the optical output reflected from the reflector;

wherein the optical detector has an output indicative of a position of the print head.

6. The printer of claim 1, wherein the optical detector is a 1-D array of charge coupled devices (CCDs) and the output of the optical detector is a digital indication from the 1-D array of CCDs.

7. The printer of claim 1, wherein the optical detector is a single CCD with a linear output rather than a digital output; and the printer further comprises a comparator that compares output voltage value with thresholds to determine relationship of the optical detector to the optical emitter.

8. A method of detecting print line loss comprising:

transmitting an optical output between at least two optical elements comprising an optical emitter and an optical detector, wherein at least one of the two optical elements is mounted on a print head of a printer, wherein the print head is moveable with respect to the stable frame element; and detecting, by one of the two optical elements, motion of the print head based on the optical output.

9. The method of claim 8, wherein the printer is a fiscal printer.

10. The method of claim 8 further comprising outputting, by the optical detector, an indication of a position of the print head.

11. The method of claim 8, wherein the optical emitter is mounted on the stable frame element; and the optical detector is mounted on the print head, the optical detector oriented so that it receives an optical output from the optical emitter, the optical detector having an output indicative of a position of the print head.

12. The method of claim 8, wherein the optical emitter is mounted on the print head; and the optical detector is mounted on the stable frame element, the optical detector oriented so that it receives an optical output from the optical emitter, the optical detector having an output indicative of a position of the print head.

13. The method of claim 8 further comprising a reflector mounted on the stable frame element;

wherein the optical emitter is mounted on the print head;

wherein the optical detector is mounted on the print head;

wherein the reflector is oriented so that it receives an optical output from the optical emitter and the optical detector is oriented so that it receives the optical output reflected from the reflector;

wherein the optical detector has an output indicative of a position of the print head.

14. The method of claim 8, wherein the optical detector is a 1-D array of charge coupled devices (CCDs) and the output of the optical detector is a digital indication from the 1-D array of CCDs.

15. The method of claim 8, wherein the optical detector is a single CCD with a linear output rather than a digital output; and the printer further comprises a comparator that compares output voltage value with thresholds to determine relationship of the optical detector to the optical emitter.

* * * * *